United States Patent [19]

Wiczer

[11] 4,168,067

[45] Sep. 18, 1979

[54] POST FOR PINBALL GAME APPARATUS

[75] Inventor: Max Wiczer, 9122 Kedvale Ave., Skokie, Ill. 60076

[73] Assignee: Max Wiczer, Skokie, Ill.

[21] Appl. No.: 853,088

[22] Filed: Nov. 21, 1977

[51] Int. Cl.[2] ..... A63B 71/00

[52] U.S. Cl. ..... 273/127 R; 248/221.4

[58] Field of Search ..... 273/127 R, 127 A, 127 B, 273/127 C, 121 R, 121 A, 121 D, 121 E, 108, 109, 118 R, 118 A, 118 D, 119 R, 119 A, 120 R, 120 A, 122 R, 122 A, 123 R, 123 A, 124 R, 124 A, 125 R, 125 A, 126 R, 126 A, 85 R, 1 R, 1 B, 14; 24/213 CS; 200/61.11; D34/5 JJ; 46/31; 248/201, 221.4; 85/90 E

[56] References Cited

U.S. PATENT DOCUMENTS

| | | | |
|---|---|---|---|
| 1,861,117 | 5/1932 | Fenton | 24/213 CS |
| 1,971,545 | 8/1934 | Tompkins | 46/25 |
| 2,520,283 | 8/1950 | Kocl | 273/121 A |
| 3,154,281 | 10/1964 | Frank | 46/31 UX |
| 3,687,092 | 8/1972 | Manning | 108/156 |
| 3,711,094 | 1/1973 | Coffman | 273/120 R |
| 3,861,685 | 1/1975 | Trbovich | 273/120 R |
| 3,979,119 | 9/1976 | Cecchetti | 273/121 R |

FOREIGN PATENT DOCUMENTS

| | | | |
|---|---|---|---|
| 2406815 | 2/1974 | Fed. Rep. of Germany | 273/121 A |

*Primary Examiner*—Richard C. Pinkham
*Assistant Examiner*—T. Brown
*Attorney, Agent, or Firm*—Vogel, Dithmar, Stotland, Stratman & Levy

[57] ABSTRACT

The post is of one-piece construction and has a body portion with a plurality of legs protruding in one direction and a lug protruding in the other. The legs are adapted to be forced toward one another so that they can be inserted into the opening of a playfield board of a pinball game. When released, the legs frictionally engage the board to hold the post in place. The lug passes through a hole in a cover plate and has fastening structure to accommodate a push-type fastener.

11 Claims, 5 Drawing Figures

POST FOR PINBALL GAME APPARATUS

BACKGROUND OF THE INVENTION

The pinball game has a playfield board and a number of pinballs propelled usually one after another onto the board. Located on the board are various kinds of ball objectives and targets which when struck register a score. One of these objectives or targets may be a rubber ring or band encircling a set of posts. A switch (or switches) has its blade protruding through an opening in the playfield board and in contact with the rubber band. When the ball strikes the band, the switch is actuated, causing a score to be registered. Also, a kicker device may be associated with the rubber band causing the ball to be rebounded at an increased speed. Usually, a decorative plastic plate is carried by these posts, which may be illuminated when the score is registered.

In the past, each such post was a plastic body having a bore therethrough. A bolt extended through the playfield board, through the bore in the post, and through a hole in the cover plate. A nut applied to the free end of the bolt held the three parts together. Undesirably, however, this required three separate parts: the post, the bolt, and the nut. Moreover, it required too much time and labor to assemble the three parts.

SUMMARY OF THE INVENTION

It is, therefore, an important object of the present invention to provide a post for use in a pinball game, which does not require a separate bolt for attachment.

Another object is to simplify the labor involved in assembling posts to the playfield board of a pinball game.

A further object is to reduce the cost of the post and associated fastening means.

In summary, there is provided a post for use in a pinball game having a playfield board for supporting a rolling pinball, the post being adapted to support a cover plate having at least one hole therein and to be attached thereto with a fastener, the playfield board having at least one opening therein defined by a cylindrical wall, the post being of one-piece construction and comprising an elongated body portion having a longitudinal axis, a plurality of legs on said body portion and extending generally parallel to the longitudinal axis, the legs being biased outwardly and being movable toward the axis to enable insertion of the legs into the opening of the playfield board, the outward biasing of the legs causing frictional engagement thereof with the wall of the opening, a lug on the other end of the body portion and extending generally parallel to the longitudinal axis, the lug having a diameter to enable insertion through the hole in the cover plate, and fastening structure on the lug for engagement with the fastener.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purposes of facilitating an understanding of the invention, there is illustrated in the accompanying drawings, a preferred embodiment thereof, from an inspection of which, when considered in connection with the following description, the invention, its construction, and operation, and many of its advantages should be readily understood and appreciated.

DESCRIPTION OF THE PREFERRED EMBODIMENT

Figure 1:
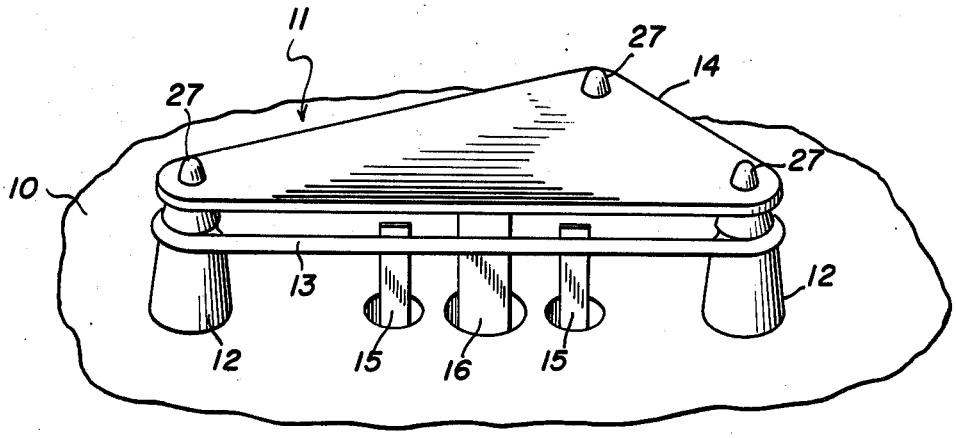
FIG. 1 is a perspective view of a kicker assembly on a fragmentary portion of a playfield board in a pinball game, such assembly including three posts incorporating the features of the present invention.
Figure 2:
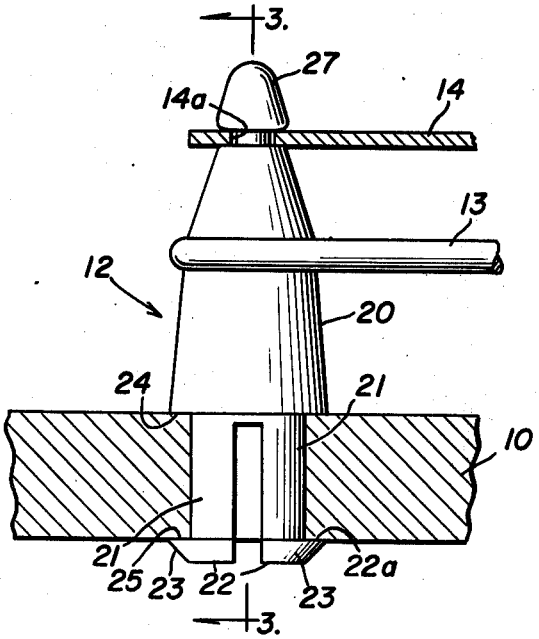
FIG. 2 is an enlarged view in elevation of a post mounted to the playfield board and carrying a rubber band and a cover plate.
Figure 3:
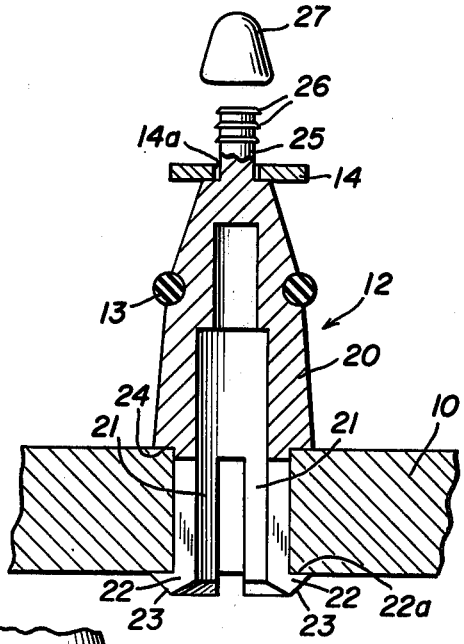
FIG. 3 is a view in vertical section taken along the line 3—3 of FIG. 2, but with the cap nut detached.
Figure 4:
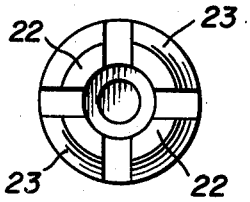
FIG. 4 is a bottom plan view of the post viewed in FIG. 2.
Figure 5:
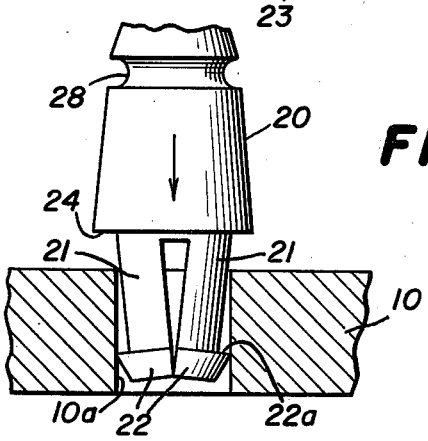
FIG. 5 is a fragmentary view of the post illustrating the legs in condition to be inserted into the playfield board opening.

Turning now to FIG. 1 of the drawings, there is shown a playfield board 10 of the pinball game. Carried on the playfield board 10 are a number of targets which when struck by a pinball will register a score. One of these targets is depicted in FIG. 1 and may be characterized as a slingshot apparatus 11. It comprises a set of three posts 12, only two of which are shown. Each post is mounted in an opening 10*a* (FIG. 5) in the board 10. Wrapped around the posts in an endless rubber ring or band 13 which usually is circular in cross section. The posts carry a cover plate 14 which may be formed of plastic and is usually imprinted with decoration. The plate 14 is preferably at least semi-transparent so that a lamp (not shown) beneath it, when illuminated, will enhance the decoration imprinted on the cover plate. The plate has a plurality of holes 14*a* (FIGS. 2 and 3).

The particular apparatus 11 illustrated in FIG. 1 has associated therewith a pair of switches respectively with switch blades 15 protruding through the playfield board 10, the switches themselves being mounted beneath the board. The blades 15 are in contact with the rubber band 13 so that when a pinball strikes the band, the blades 15 are caused to shift, actuating the switch, which in turn causes a score to be registered. The switches associated with the blades 15 cause actuation of a solenoid (not shown) also beneath the playfield board which pivots an arm 16 forcefully into the rubber band 13, causing the pinball to be rebounded at increased speed.

A pinball game may have one or more apparatuses like that shown in FIG. 1. In addition, other apparatuses may incorporate two or more of the posts 12, a rubber band 13, a plate 14 (perhaps of different shape), and one or more switches; it may or may not have an arm 16. Also, each apparatus may include a lamp beneath the cover plate 14 for illumination thereof when the apparatus is impinged by the pinball.

Turning now to FIGS. 2–5, details of each of the posts 12 will be described. The post 12 includes a body portion 20, a set of four legs 21, each carrying a laterally protruding foot 22. The outer end of each foot 22 is bevelled to define a guide surface 23.

The lower end of the body 20 has a diameter greater than the diameter of the legs 21 so as to define a shoulder 24 adapted to rest on the upper surface of the playfield board 10. The protruding portion of each foot 22 has a laterally extending surface 22*a* disposed generally parallel to the shoulder 24 and spaced therefrom, preferably an amount substantially equal to the thickness of the playfield board 10.

To mount the post 12, its legs 21 are urged toward one another, thereby reducing the effective diameter of the legs to a point corresponding to the diameter of the opening 10*a* in the playfield board 10. The guide surface 23 help to guide the legs 21 into the opening 10*a*. The post 12 is pushed down until the shoulder 24 lies against the top surface of the playfield board 10, at which point the feet 22 will have returned to their rest position, and the surfaces 22*a* are disposed beneath the playfield board 10. After the posts 12 so are mounted, the rubber band 13 is positioned so as to seat in each an annular groove 28.

The post 12 includes at the end opposite the legs 21, an upstanding lug 25 which has a diameter less than the diameter of each hole 14*a* in the cover plate 14. The lug 25 carries fastening structure, the form shown being three angular rings or ridges 26 for use in frictionally engaging a cap nut 27. After the cover plate 14 is dropped into position, the cap nut 27 is pushed onto the lug 25 and is held thereon by the ridges 26.

What has been described therefore is an improved post for a pinball game which can be mounted on the playfield board without the use of tools, simply by urging its legs together, and inserting it in the corresponding hole in the board. The legs return to their rest position thereby frictionally holding the post. Likewise, the cover plate is mounted by simply dropping it into place on the lugs of the posts and then applying the cap nuts.

I claim:

1. A post for use in a pinball game having a playfield board for supporting a rolling pinball, the post being adapted to support above the playfield board a cover plate having at least one hole therein and to be attached thereto with a fastener, the playfield board having at least one opening therein, said post being of one-piece construction and comprising an elongated body portion having a longitudinal axis and a predetermined transverse dimension, a plurality of flexible legs on one end of said body portion and extending generally parallel to said longitudinal axis, said legs being spaced outwardly from said longitudinal axis when in a normal rest position and adapted to be bendably movable toward said axis when said legs are inserted into the opening of the playfield board by way of the surface on which the pinball rolls, after insertion of said legs into said opening said legs returning to said normal rest position to cause frictional engagement thereof with the wall of the opening, a fastening lug on the other end of said body portion said lug extending generally parallel to said longitudinal axis, said lug having a transverse dimension less than said transverse dimension of said body portion; a fastener for engaging said lug, and means between said fastener and said lug for securing them together.

2. The post of claim 1, wherein said body portion has an annular groove perpendicular to said longitudinal axis and accommodating a rubber band.

3. The post of claim 1, and having four of said legs.

4. The post of claim 1, wherein each of said legs is part arcuate in transverse cross section.

5. The post of claim 1, wherein said legs are inwardly offset from said body portion to define a shoulder substantially perpendicular to the longitudinal axis, said shoulder being adapted to rest on the upper surface of the playfield board.

6. The post of claim 5, and further comprising a laterally extending foot on the free end of each leg for engagement with the bottom surface of the playfield board, said feet and said shoulder cooperating to inhibit movement of said post with respect to the playfield board.

7. The post of claim 1, wherein said securing means on said lug is a plurality of annular ridges thereon substantially parallel to one another and said fastener is a push-type fastener.

8. The post of claim 1, and further comprising a laterally extending foot on the free end of each leg for engagement with the bottom surface of a playfield board.

9. The post of claim 8, wherein each foot has an inclined surface for guiding said foot and the associated leg into the opening in the playfield board.

10. The combination for use in a pinball game having a playfield board for supporting a rolling pinball, the playfield board having at least one opening therein, the combination comprising a post of one-piece construction and including an elongated body portion and a plurality of flexible legs and a lug, said elongated body portion having a longitudinal axis, said legs being on one end of said body portion and extending generally parallel to said longitudinal axis, said legs being spaced outwardly from said longitudinal axis in a normal rest position and being bendingly movable toward said axis to enable insertion of said legs into the opening of the playfield board, after insertion into said opening said legs returning to said normal rest position to cause frictional engagement thereof with the wall of the opening, said lug being on said other end of said body portion and extending generally parallel to said longitudinal axis; and a cover plate having at least one hole therein through which passes said lug and fastening means attached to said lug.

11. The combination of claim 10, and further comprising a push-type fastener for engaging said fastening structure on said lug.

* * * * *